US006129600A

United States Patent [19]

Nordby

[11] Patent Number: 6,129,600

[45] Date of Patent: Oct. 10, 2000

[54] PADDLE FLOATATION APPARATUS FOR KAYAK SELF RESCUE

[76] Inventor: Willard E. Nordby, 5 Carmel Dr., Novato, Calif. 94945

[21] Appl. No.: 09/470,307

[22] Filed: Dec. 22, 1999

[51] Int. Cl.[7] ..... B63H 16/04

[52] U.S. Cl. ..... 440/101; 114/347

[58] Field of Search ..... 441/80, 122, 59; 440/101; 114/123, 347

[56] References Cited

U.S. PATENT DOCUMENTS 5,279,248 1/1994 Blachford ..... 114/347

*Primary Examiner*—Ed Swinehart

*Attorney, Agent, or Firm*—Johnson & Stainbrook; Larry D. Johnson; Craig M. Stainbrook

[57] ABSTRACT

An improved paddle floatation apparatus comprising a unitary inflatable sleeve that fits over a kayak or other shallow draft watercraft paddle blade. When installed on a paddle blade, the entire paddle may be configured as an outrigger to assist the user in righting the kayak and reentering the cockpit from the water. The shape of the float when inflated is substantially triangular when viewed on end and includes numerous stabilizing surfaces that engage the water to resist unintentional movement in every direction.

8 Claims, 2 Drawing Sheets

PADDLE FLOATATION APPARATUS FOR KAYAK SELF RESCUE

BACKGROUND OF THE INVENTION

1. Field of the Invention

The present invention relates generally to an apparatus for self rescue from a capsized kayak, and more particularly to an improved inflatable paddle floatation device for connection to a kayak paddle blade that is then deployable as an outrigger to assist in solo reentry to a capsized kayak.

2. Description of the Prior Art

Kayaking in rough waters always carries with it the inherent risk of capsizing. After a capsize in cold waters, life threatening issues of hypothermia or drowning are of immediate concern. Several methods exist for righting and reentering overturned kayaks. Skilled kayakers frequently execute an Eskimo roll to right an inverted kayak. If the capsize caused or compelled egress from the cockpit, the paddler may reenter the cockpit upside down and underwater before executing the roll. However, very rough seas or lack of skill sometimes makes it impossible to successfully complete such a skilled maneuver. Accordingly, there exists in the prior art several devices to assist kayakers in righting and/or reentering capsized kayaks.

Among such devices, U.S. Pat. No. 5,279,248 describes a device having a rapidly self-inflating means for floatation with a minimum volume of one cubic foot of gas. It is adapted for positioning to one side of the kayak, spaced from the kayak for movement in an arc of at least 90 degrees about the kayak by means of force applied to the handle of the device. After capsize, the handle of the floatation device is grasped and the device inflated. Force is then applied to the handle to rotate the kayak and paddler to an upright position.

It is also well known in the art to use a PADDLE FLOAT to assist in self rescue or solo reentry into a capsized kayak. The most commonly used device, an invention of the present inventor and bearing the registered trademark name of PADDLE FLOAT, which mark is owned by the present inventor, is an inflatable or foam sheath, jacket, collar or cuff. The sheath is open at each end and fits over one of the kayak paddle blades so that one end of the paddle becomes significantly buoyant. The paddle may then be deployed as an outrigger to assist in the self rescue effort.

Currently marketed inflatable kayak paddle floatation devices comprise an inflatable envelope having an internal cavity or sleeve that fits over the kayak paddle blade. The earliest and most widely employed technique for using this kind of paddle floatation device in kayak self rescue is the non-fixed paddle-float rescue. This method typically involves the following steps:

(1) turning the capsized kayak into the upright position and hanging onto the kayak;

(2) selecting a side for reentry and taking a position beside the cockpit;

(3) removing the floatation device from its storage place and placing it over one of the paddle blades;

(4) holding the float onto the blade and preferably against the loom while opening the push-pull valve with the teeth;

(5) inflating the float until it is secure on the blade and sufficiently full to provide buoyancy;

(6) closing the valve with the teeth;

(7) placing the paddle shaft across the deck and under deck lines fore or aft of the cockpit and at a right angle to the gunwale, with the inflated floatation device extended as an outrigger;

(8) while maintaining grip on the paddle shaft, grasping the coaming or the cockpit edge with the other hand;

(9) kicking the legs to the water surface and simultaneously pulling with both arms to thrust the body onto the kayak centerline;

(10) if necessary, hooking feet over the paddle so that some of the body weight is supported by the float, and then twisting to insert the feet into the cockpit;

(11) if step 10 not taken, sitting upright with the legs on either side of the kayak;

(12) sliding into the cockpit and lowering onto the seat to assume a normal paddling position.

After recovery the kayak may be bailed out and the spray skirt (if any) replaced. This same technique, excluding inflation, is used when using a foam float.

The foregoing method is well-suited for relatively gentle water conditions. However, when seas are rough this method has a significant shortcoming attributable to currently existing paddle floatation device characteristics and features. Most notably, because they lack stabilizing structures, the inflated floatation devices tend to slide across the surface of the water and scissor towards the kayak, thus reducing and at times eliminating the buoyancy advantage they theoretically offer.

Accordingly, an alternative to the non-fixed paddle-float rescue has been devised: namely, the fixed outrigger paddle floatation device rescue. In this method, after inflating the float, the paddle blade is secured in its outrigger position by fastening straps or lines to the float from the deck of the kayak on either or both sides of the float. While providing increased stability during the self rescue procedure, the technique may entail another step in an already urgent procedure, makes paddle retrieval more difficult, and creates a risk of entanglement.

Yet another method of using existing paddle floatation devices in kayak self rescue is as an aid in a reentry and roll recovery. This method is more suitable for rough sea conditions when the kayak is inverted and requires that the kayaker have at least some understanding of and proficiency with reentry and roll techniques. It is significantly easier to execute than an Eskimo roll without a paddle floatation device. The technique includes the following steps:

(1) taking a position alongside the inverted kayak;

(2) placing the paddle floatation device onto the paddle blade and inflating;

(3) taking a position beside the cockpit and facing stern;

(4) grasping the paddle loom along its length (with the longer, float end toward the bow), and holding it against the near coaming;

(5) reaching across the cockpit and grasping the opposite coaming;

(6) taking a deep breath and quickly leaning back;

(7) employing a backward somersault, thrusting both legs into the cockpit and taking a position securely inside, upside down and underwater;

(8) positioning the paddle parallel to the kayak side in preparation for an Eskimo roll;

(9) sweeping outwardly with the float end and then pulling briskly downward so as to come to a full upright position.

Finally, still another technique is a modified reentry and roll, used when the kayak is in the upright position. In this technique, the kayaker deploys the float and holds the paddle at right angles to the kayak while holding the front of the coaming. She then tips the kayak toward her in the water and pulls her feet into the cockpit (at this point the kayak is generally leaning on its side with the cockpit half submerged). She then slides into the cockpit while holding the paddle. Once securely in the cockpit, the kayaker leans onto the paddle as a brace and pulls against the buoyancy of the float; simultaneously and swiftly she shifts her weight with a sideways pelvic tilt. This will right the kayak.

All of the foregoing techniques require a degree of lateral stability in the outrigger paddle. However, existing paddle floatation devices share the shortcoming of being unstable in rough seas or windy conditions. Because the float lays generally flat on top of the water, it has a tendency to move, or "slide," easily across the water, thus radially or laterally closing the distance to the kayak. Additionally, it may simply slide away from the kayak if the user does not maintain a firm enough grip.

SUMMARY OF THE INVENTION

The apparatus of the present invention is an improved paddle floatation apparatus that overcomes the deficiencies of prior art floats in a number of ways. The present float comprises a unitary inflatable sleeve which fits over a paddle blade for a kayak or other shallow draft watercraft. When the float is installed on a paddle blade, the entire paddle may be configured as an outrigger to assist the user in righting the kayak and reentering the cockpit from the water. The float is open at both ends, and the shape of the float when inflated is substantially triangular when viewed on end and includes numerous stabilizing surfaces that engage the water to resist unintentional movement in every direction. Consequently, the float has more stability when in use and much less need to be fixed or secured to the kayak to ensure that it remain in an outrigger configuration during the reentry maneuver.

DETAILED DESCRIPTION OF A PREFERRED EMBODIMENT

Figure 1:
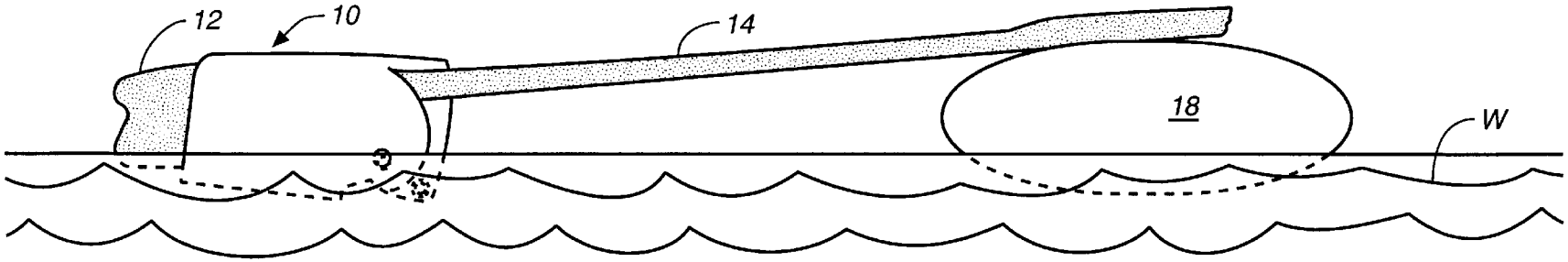
FIG. 1 is a side elevation view of the improved paddle floatation apparatus of the present invention, showing the float deployed on a paddle outrigger to assist in kayak self rescue.

FIG. 1 is a side elevation view of the paddle floatation apparatus of the present invention, showing the float deployed as part of an paddle outrigger to assist in kayak self rescue. As may be readily appreciated, the paddle floatation apparatus 10 is fit over a paddle blade 12 at one end of a double bladed kayak paddle 14, which is secured to a kayak 18 and configured in an outrigger position ideally at a substantially 90 degree angle relative to the side of the kayak. The buoyant inflated float remains on or near the surface of the water W so as to provide the floating portion of a paddle outrigger against which the kayaker can brace herself as she pulls herself back into the kayak, as described in "Description of Prior Art," supra.

Figure 2:
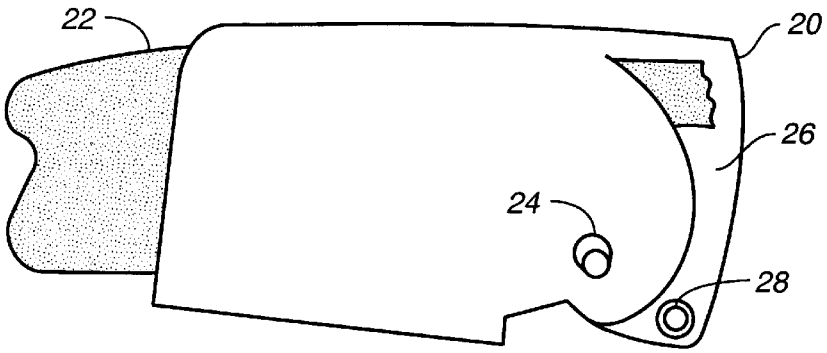
FIG. 2 is a side elevation view of the improved paddle floatation apparatus of the present invention.

FIG. 2 is a left side elevation view of the improved paddle floatation apparatus 10 of the present invention showing a paddle blade inserted into the interior space in the float. The interior space is a sleeve or cavity that angles downwardly so that the paddle blade itself also angles downwardly from the float's proximal end 20 to its distal end 22. This allows the float to remain relatively flat on the surface of the water despite the angle of the paddle handle or loom as it extends from the kayak deck to the water. Located at the proximal end are push-pull valve 24 for inflating the float, and collar 26 for pulling the float over the blade. The collar may have one or more grommets 28 for securing the float to the kayak deck when not in use and/or securing the float to the kayak with a strap when deployed. Additionally, the collar may contain floatation means for keeping the device afloat even when not inflated (not pictured). Such means may include a piece of foam inserted into a sealed pocket in the collar (also not pictured).

Figure 3A:
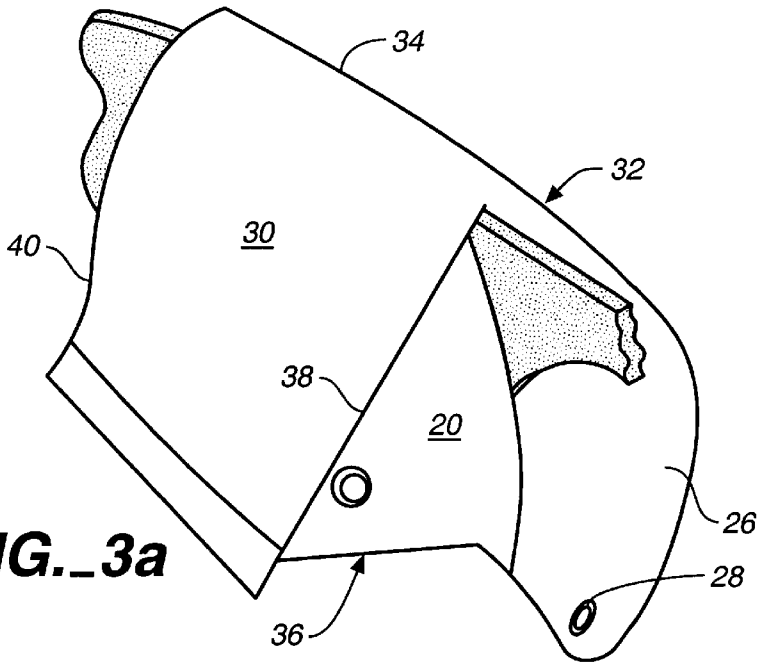
FIG. 3*a* is a perspective view of the proximal end of the float, inflated and installed on a paddle.
Figure 3B:
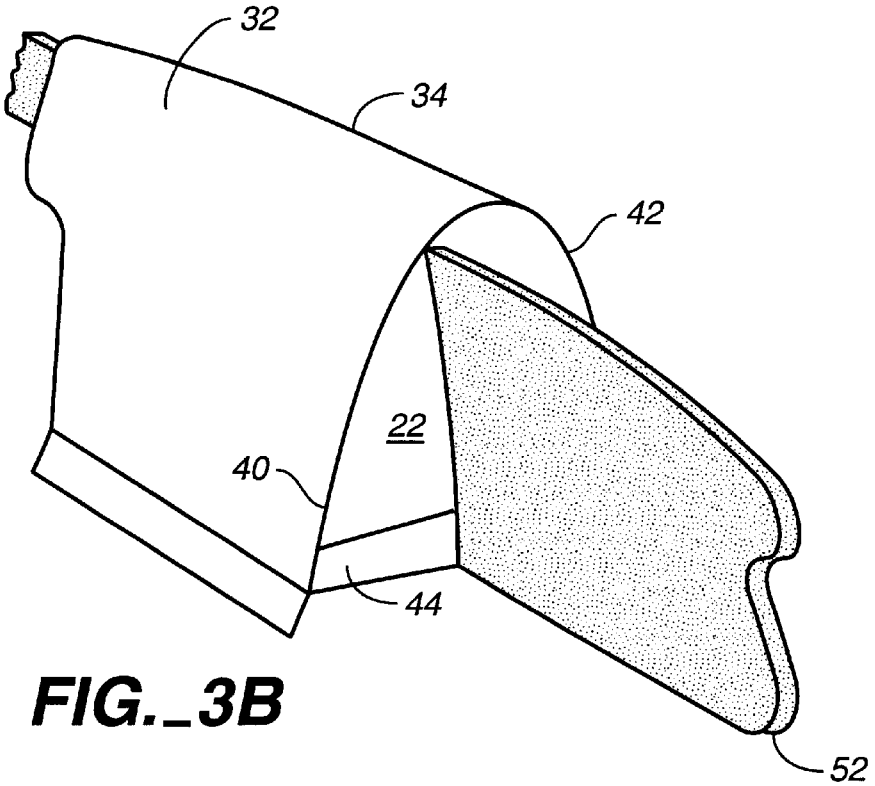
FIG. 3*b* is a right perspective view of the distal end of the float, inflated and installed on a paddle.

FIG. 3*a* is a perspective view showing the proximal end of the float, and FIG. 3*b* is a perspective view of the float showing its distal end. These views show that the inflated float has a generally triangular shape when viewed on end, and comprises a unitary inflatable sleeve having a left side 30, a right side 32, an upper angled ridge 34, and a bottom side 36. The float preferably has a single air chamber the internal walls of which define an interior slot for fitting over the paddle blade. The proximal end 20 is slightly recessed so that the left side proximal edge 38 complements the collar 26, said collar integral with said right side 32 in extending outwardly from the end to form integral stabilizing fins.

The distal end 22 of the float is also recessed slightly so that integral stabilizing fins are formed of the left side distal edge 40, the right side distal edge 42, and the bottom side distal edge 44.

Figure 4:
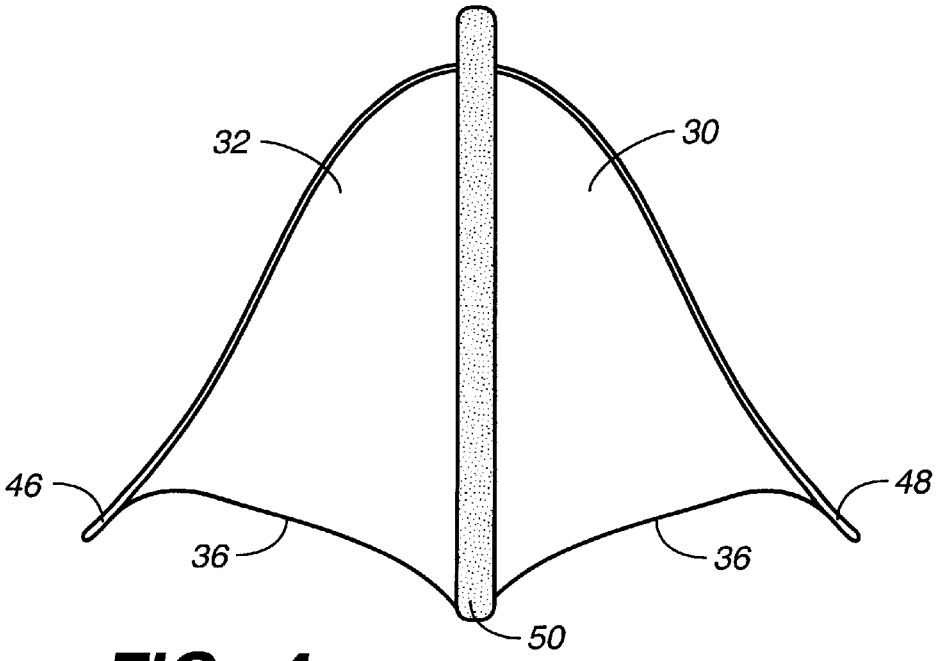
FIG. 4 is a distal end view of the float, inflated and installed on a paddle.

Additionally, as is shown in FIG. 4, the walls of both the left side 30 and the right side 32 extend below the bottom side 36 to form a left integral stabilizing fin 46 and a right integral stabilizing fin 48.

When fitted into the paddle floatation apparatus, the paddle blade stands in a upright manner so that it is generally perpendicular to the hypothetical plane of the water surface (the plane of the water when perfectly smooth). Viewed from the distal end, as in FIG. 4, it is seen that the lower edge 50 of the paddle blade forms a keel to provide added lateral stability to the float when in use, and the paddle tip 52 extends beyond the distal end to achieve the same purpose (see FIG. 3*b*).

The attitude of the float when in use and the constellation of stabilizing surfaces provide the present invention with significantly more radial and lateral stability than prior paddle floatation devices. The paddle tip 52, lower paddle edge 50, left stabilizing fin 46, right stabilizing fin 48, collar 18, left side proximal edge 38, left side distal edge 40, and right side distal edge 42, all provide lateral stability to help keep the float in a selected position relative to the kayak when deployed. Thus, unlike existing paddle floatation devices, the present invention will resist "sliding" along the surface of the water to scissor radially towards the kayak. Furthermore, the stabilizing surfaces of the present invention, particularly those created by the recessed ends, provide increased resistance to moving directly toward or away from the kayak along the line of the paddle shaft when in use, and to resist inadvertently lifting the float out of the water. The end result is a sturdier ad hoc outrigger for assistance in reentering a kayak from the water.

The paddle floatation apparatus of the present invention is designed for feathered paddles, but it may be adapted for use with non-feathered paddles as well, with many of the above-described advantages still in evidence. Although the keel effect created by the lower edge of the blade will not be available to provide lateral stability, the proximal and distal stabilizing surfaces will still function.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. A paddle floatation apparatus for connection to a kayak paddle blade that is then deployable as an outrigger to aid in solo reentry to a capsized kayak, said apparatus comprising:

a unitary inflatable sleeve having an interior slot adapted to fit over a kayak paddle blade and to hold said kayak blade firmly in place when inflated;

a valve for the introduction and release of air from said inflatable sleeve; and a plurality of stabilizing fins for resisting movement of said paddle floatation apparatus when in use.

2. The paddle floatation apparatus of claim 1 wherein said unitary inflatable sleeve has a left side, a right side, a bottom side, an upper angled ridge, a distal end, a proximal end, and a substantially triangular shape when inflated and viewed on end.

3. The paddle floatation apparatus of claim 2 wherein said distal and proximal ends are recessed, and wherein said plurality of stabilizing fins includes:

a left proximal edge stabilizing fin integral with said left side and extending outwardly and beyond said proximal end;

a left distal edge stabilizing fin integral with said left side and extending outwardly and beyond said distal end;

a right distal edge stabilizing fin integral with said right side and extending outwardly and beyond said distal end; and a bottom distal stabilizing fin integral with said bottom side and extending outwardly and beyond said distal end.

4. The paddle floatation apparatus of claim 2 further including a collar integral with said right side and extending as a flap.

5. The paddle floatation apparatus of claim 4 wherein said collar has a grommet for securing said paddle floatation apparatus to a kayak.

6. The paddle floatation apparatus of claim 2 wherein said unitary inflatable sleeve holds the paddle blade such that the paddle angles downwardly from its proximal to distal ends.

7. The paddle floatation apparatus of claim 1 wherein said unitary inflatable sleeve holds the paddle blade substantially perpendicular to the plane of the water while in use.

8. The paddle floatation apparatus of claim 1 wherein said unitary inflatable sleeve holds the paddle blade such that the lower edge of the paddle blade forms a keel in the bottom of said float to provide increased lateral stability.

* * * * *